US007147009B1

(12) United States Patent
Murcar

(10) Patent No.: US 7,147,009 B1
(45) Date of Patent: Dec. 12, 2006

(54) METHOD FOR HANDS ONLY WEAVING

(76) Inventor: Diana Lynn Murcar, 34799 Evergreen Way, Ridge Manor, FL (US) 33523

( * ) Notice: Subject to any disclaimer, the term of this patent is extended or adjusted under 35 U.S.C. 154(b) by 0 days.

(21) Appl. No.: 11/003,087

(22) Filed: Dec. 3, 2004

(51) Int. Cl.
*D03D 29/00* (2006.01)
*B65H 69/04* (2006.01)
*G09B 19/20* (2006.01)
*D04B 4/00* (2006.01)

(52) U.S. Cl. ..... 139/33; 139/29; 66/1 A; 66/117; 66/4; 434/95; 446/144; 289/18.1

(58) Field of Classification Search ..... 139/29, 139/33; 66/1 A, 117, 4; 434/95; 289/1.5, 289/17, 18.1; 446/144
See application file for complete search history.

(56) References Cited

U.S. PATENT DOCUMENTS

| | | | | | |
|---|---|---|---|---|---|
| 370,893 | A * | 10/1887 | Royce | 242/153 |
| 983,764 | A * | 2/1911 | Putman | 139/33 |
| 2,136,552 | A * | 11/1938 | Le Page | 28/152 |
| 2,142,608 | A * | 1/1939 | Hockert | 242/149 |
| 2,244,903 | A * | 6/1941 | Walk et al. | 242/153 |
| 2,424,880 | A * | 7/1947 | Dillon | 139/33 |
| 2,463,365 | A * | 3/1949 | Epstein | 139/34 |
| 2,527,333 | A * | 10/1950 | Raizen | 28/151 |
| 2,563,510 | A * | 8/1951 | Bellin | 139/1 R |
| 2,563,678 | A * | 8/1951 | Gates | 289/1.5 |
| 2,601,715 | A * | 7/1952 | Simonds | 28/152 |
| 3,388,441 | A * | 6/1968 | Snyder | 28/299 |
| 3,776,280 | A * | 12/1973 | Kliot | 139/33 |
| 4,063,574 | A * | 12/1977 | Miller | 139/29 |
| 4,074,726 | A * | 2/1978 | Harris | 139/29 |
| 4,578,036 | A * | 3/1986 | Leighton | 434/95 |
| 6,149,437 | A * | 11/2000 | Corliss | 434/95 |
| 6,389,674 | B1 * | 5/2002 | Beavers-La Rue | 29/460 |
| D469,818 | S * | 2/2003 | Asou | D21/398 |
| 6,834,682 | B1 * | 12/2004 | Jenner et al. | 139/29 |

OTHER PUBLICATIONS

Kids Can Make It, Inc., Finger Knitting, 2002, entire document.*
Camp-a-roo.com, Gifts kids can make, source code dated Aug. 19, 1999, entire document.*

* cited by examiner

*Primary Examiner*—Gary L. Welch
*Assistant Examiner*—Robert Muromoto
(74) *Attorney, Agent, or Firm*—Daniel S. Polley, P.A.

(57) ABSTRACT

A process for weaving that can be implemented using just the hands as the loom and shuttle, a weaving material such as yarn, an instrument for cutting like nail clippers or a small pair of scissors, and an object for intermissions in the process such as a paper clip. The weaving process is simplified to the most basic concepts of weaving that can be enjoyed by any age group, such as, but not limited to, from five-year-old children to adults. The absence of barriers like cumbersome weaving looms permits the process to be practiced in a multitude of settings.

20 Claims, 8 Drawing Sheets

METHOD FOR HANDS ONLY WEAVING

1. Field of the Invention

Figure 1:
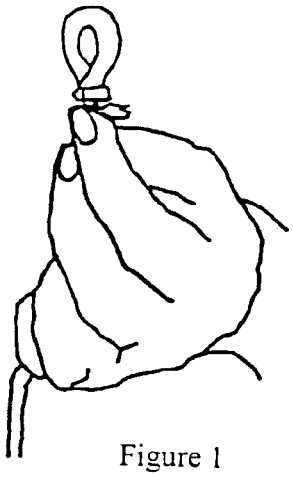

The present invention relates generally to a weaving process and particularly to a hands only weaving process.

2. Background of the Invention

Weaving is an ancient process that has been used by a multitude of historical and contemporary civilization for aesthetic and functional purposes. The weaving looms that are available for use, whether of cardboard construction or mechanical structure, have similar limits in regard to ease of use, which often include issues related to size, convenience, and ability to operate the mechanisms. These limits prohibit opportunities for instruction as well as participation in the art and craft as it is difficult to keep the warp strands in place in the simpler of looms and complicated to set the warp strands in the more complicated looms. Furthermore, the weft strands tend to pull-in under the tension of the process generating unsatisfactory results. The cost alone of a loom can also be a major barrier for individual or educational use of the art and craft of weaving.

Some prior patents attempting to simplify the weaving process include U.S. Pat. No. 2,136,552 titled "Hand Loom," issued to Page on Nov. 15, 1938; U.S. Pat. No. 2,527,333 titled "Toy Handweaving Device" issued to Raizen on Oct. 24, 1950; U.S. Pat. No. 2,601,715 titled "Weaving Device" issued to Simonds on Jul. 1, 1952; U.S. Pat. No. 6,149,437 titled "Method for making toys from pliant rods" issued to Corliss on Nov. 21, 2000 and U.S. Design Pat. No. D469,818 titled "Hand-Knitting Toy" issued to Asou on Feb. 4, 2003.

The devices shown in these patents present similar issues regarding ease of use. A loom is needed to implement the process of weaving. The "Weaving Device" and "Method for making toys from pliant rods" patents also call for a unique material to be used for the weaving process.

BRIEF SUMMARY OF THE INVENTION

The present invention provides a method for hands only weaving without a manufactured loom, which can allow for ease of use to enable participation in the art and craft of weaving. When performing the process of the present invention, the weaving strands should be kept on the fingers and the weaving can be allowed to cascade down the palm side of the hand as it grows. The present invention process can be practiced in a multiple of settings. The weaving can be created on any hand or foot or approximation thereof using as few as two or all of the appendages thereof. Though not considered limiting, the description of the present invention method for purposes of explanation will entail the application of the hand and the use of all of the digits as warp features for the weaving. Some general steps, which are discussed and further broken down into more steps, for the present invention hands only weaving process can include:

1. The induction of the strand as it is woven in this fashion. The strand can be attached to the loom (hand) by any known manner, such as, but not limited to, tying a loop on the end and placing it on one of the warp features (digits). The strand can then be woven over, under, and between the warp features (digits) until there are preferably at least two strands across each of the warp features (digits).

2. At least one strand can then be lifted over the other(s) and then removed from the end of the warp feature (digit).

3. At this point, more of the strand is woven into the loom in a manner stated in general step 1 until there are at least two strands across each warp feature (digit). The procedure stated in general step 2 is repeated. This procedure continues until there is a product that can measure from approximately ¼" to indefinite length. If desired, an additional strand may be attached at the end of the previous with a square knot.

4. If there is an interruption to the weaving process, the generating loops can be secured with any known apparatus, such as, but not limited to, a paperclip, hair pin, bobby pin, safety pin, etc. to avoid unraveling of the weaving. The weaving can be continued simply by replacing the generating loops on the warp features (digits) and removing the securing apparatus.

5. The length and the width of the weaving can be modified by lacing the ends or sides of terminated rib of weavings together. These modifications enable the products of the present invention fingertip weaving to be created into many different articles.

When performing the steps of the present invention hands only weaving process, control should be maintained on the tightness or looseness of the weave by the placement of the weaving strands between the base knuckle joint by the hand to the tips of the fingers, and to allow the weaving to cascade down the palm side of the hand as it grows. The present invention process can be used to create many different articles, including, but not limited to, hats, scarves, blankets, nets, headbands, shawls, ponchos, sweaters, etc.

It is an object of the present invention to provide a hands only weaving process.

It is another object of the present invention to provide a hands only weaving process not requiring the use of any manufactured looms.

BRIEF DESCRIPTION OF THE DIAGRAMS

FIGS. 1–48 are perspective views illustrating, in detail, the various steps which can be used for the present invention hands only weaving process.

Figure 3:
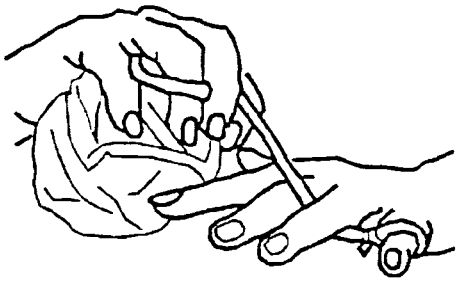
Figure 9:
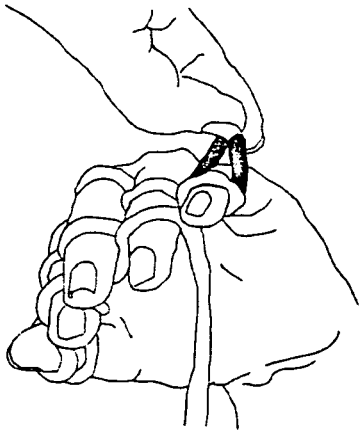
Figure 23:
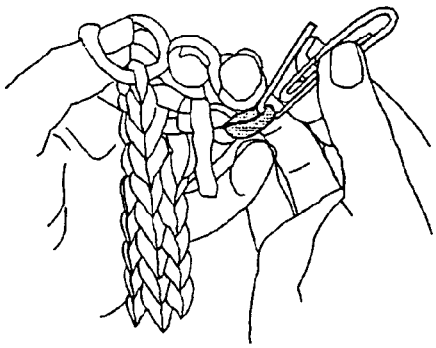
Figure 24:
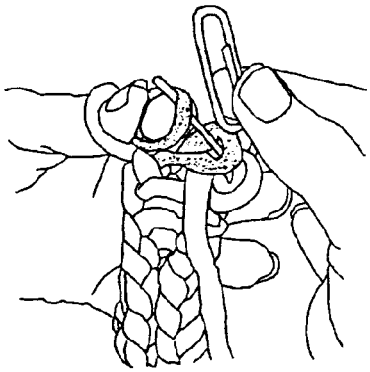
Figure 25:
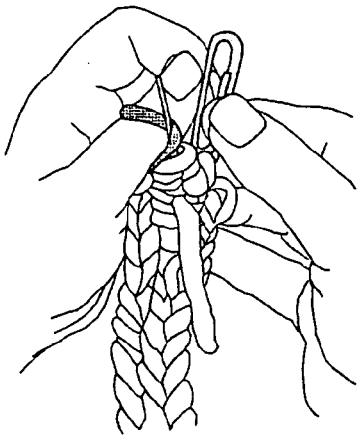
Figure 26:
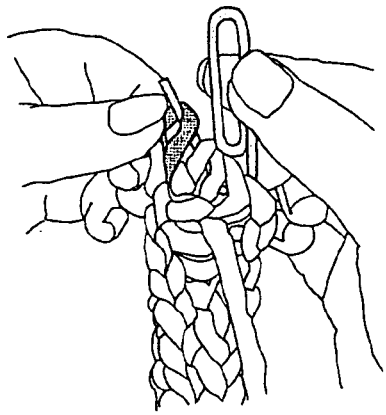
Figure 30:
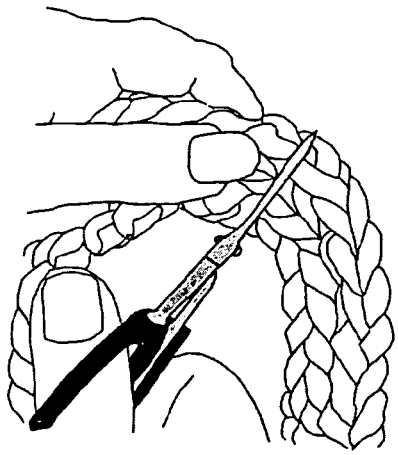
Figure 44:
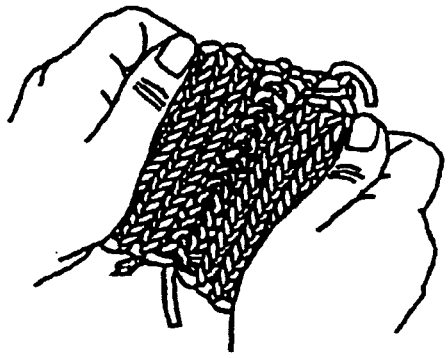

Some key figures include FIG. 3 which illustrates the use of both hands as the loom and shuttle for Hands Only Weaving. The dominant (working) hand serves as the shuttle; the non-dominant (holding) hand is the loom; FIG. 9 which illustrates the first step necessary to complete a row of Hands Only Weaving; FIG. 23 which illustrates the use of an object such as a paper clip to remove the weaving from the holding hand for storage when there is an intermission in the process; FIG. 30 which illustrates the beginning of modifications to the length of a given rib of Hands Only Weaving; and FIG. 44 illustrates the appearance of the weaving as the width has been increased as two ribs have been joined together.

DETAILED DESCRIPTION OF THE INVENTION

FIGS. 1–48 illustrate the various steps involved for the present invention hands only weaving process including the steps used to join two or more ribs to create the potential for fashioning the weaving into many different articles which includes, but is not limited to, blankets, sweaters, etc. Initially, to better understand the present invention process a list of terms, along with their definitions, will be provided:

(1) Definitions for General Weaving Terms Include:

a. Loom—a structure that is used as a form for weaving.

b. Shuttle—a structure that is used to pass material through the weaving loom.

c. Warp—the part of a structure that is woven around.

d. Weft—the part of the weaving that is added to the warp.

(2) Terms Specially Defined for the Present Invention Hands Only Weaving Process Include:

Holding hand—the non-dominant hand which serves as the loom. Though not limiting, the left hand can serve as the holding hand for a right handed practitioner and the right hand can serve as the holding hand for a left handed practitioner.

Working hand—the dominant hand which serves as the shuttle. Though not limiting, the right hand can serve as the working hand for a right handed practitioner and the left hand can serve as the working hand for a left handed practitioner.

Loops—basic structure of the weaving. Used to perpetuate, terminate, and assemble the weaving and related weaving products.

Tail—the originating end of the weaving.

Head—the generating end of the weaving from which the process may be secured, continued or terminated.

Rib—any segment of weaving, can be of any length.

Run—one set of weaving the thread over and under the digits. There can be four complete runs to begin the weaving and two complete runs to create a row. This can also be referred to as a pass.

Row—this is a completed set of runs, especially when the weft threads have been taken off and over the tips of the fingers which serve as the warp features.

Warp features—the digits of the holding hand in fingertip weaving. The digits are referred to as the pinky, ring, middle, index, and thumb.

(3) Description of the Hands Only Weaving Process a. Beginning the Weave

Figure 2:
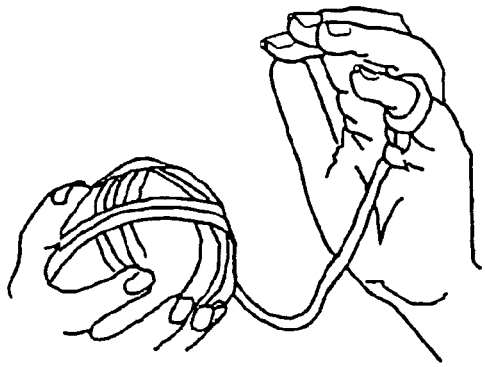
Figure 4:
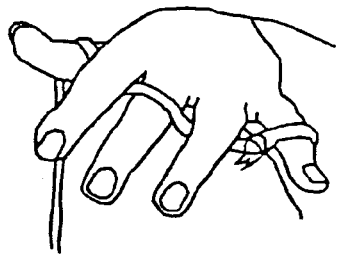

As seen in FIGS. 1 and 2 the process begins with a simple loop that will fit onto the designated finger, such as, but not limited to, the pinky finger. The holding hand becomes a weaving loom at this point as the loop is placed upon the pinky. An alternative to providing a loop can be wrapping the strand around the pinky two or three times counter clockwise. In FIGS. 3 and 4 the weaving begins as the strand begins a run under the ring finger and over the middle finger, with the run continuing under the next warp feature. In this procedure that is the index finger, and the over the thumb. This completes the first run.

Figure 5:
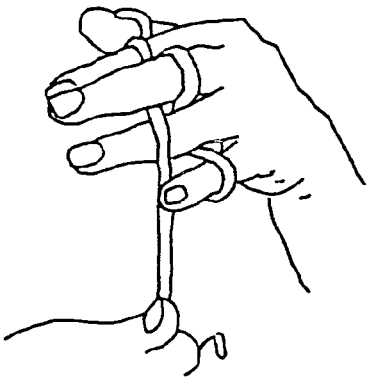
Figure 6:
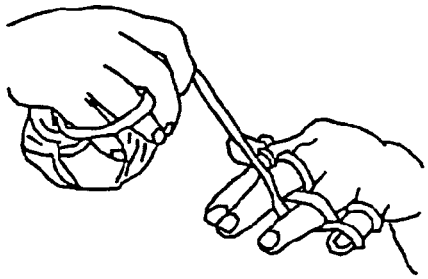
Figure 7:
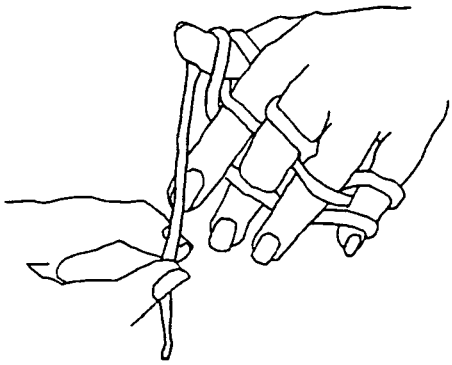
Figure 8:
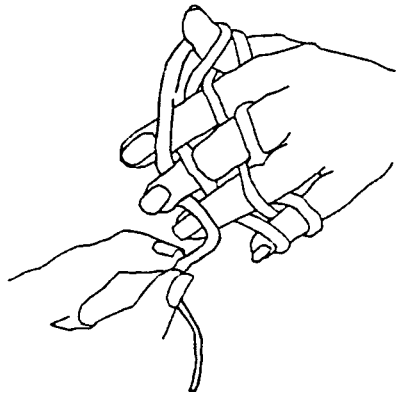

As seen in FIG. 5 the weaving continues with the second run under the thumb; over the index, under the middle, and over the ring finger. In FIG. 6 the third run is shown being made under and over the pinky then continuing the path under the ring, over the middle, and so on to the thumb. FIGS. 7 and 8 show the fourth and final run, which continues under the thumb and is completed over the index, under the middle, and over the ring where it rests as the next step is implemented.

Figure 10:
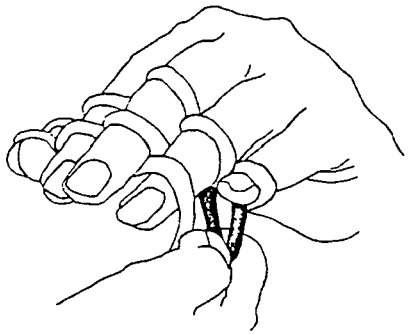
Figure 11:
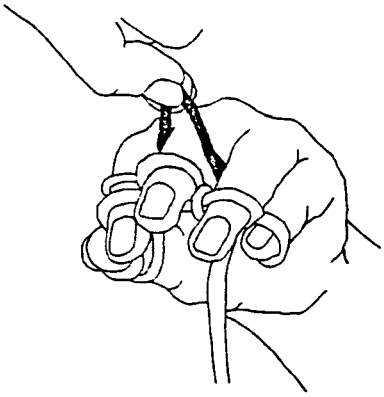
Figure 12:
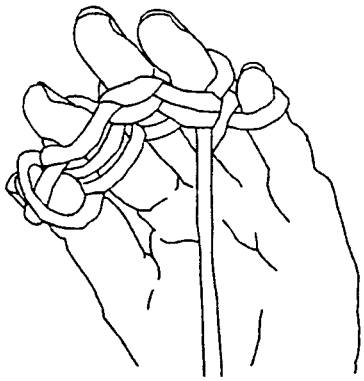

As seen in FIG. 9, in order to complete a row, the strands of the first and second runs can be lifted over the strands of the third and fourth runs and off of the tips of the digits (warp features). Beginning with the pinky the strand is lifted closest to the hand up and over the strand closest to the tip of that digit. In FIG. 10 the movement is shown continued to remove the strand off of the tip of that digit and release the hold. In FIG. 11 the motion is repeated to remove the strands closest to the hand over the strands closest to the tip of the related digit until all five digits have one strand remaining in place. A sequential method of moving from pinky to thumb can encourage consistency in technique to help in creating a uniform weave. By removing the strand indicated in this step, a "dropped loop" error can be eliminated. FIG. 12 shows that the weaving can be examined as it begins to generate on the palm side of the hand.

b. Continuing the Weave

Figure 13:
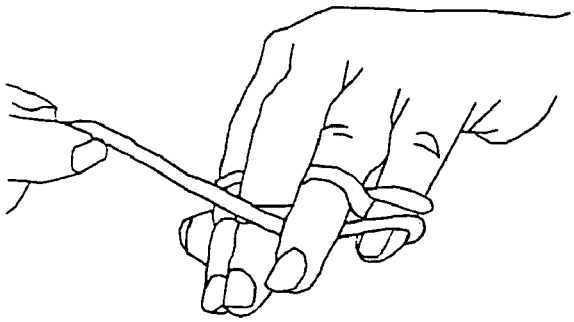
Figure 14:
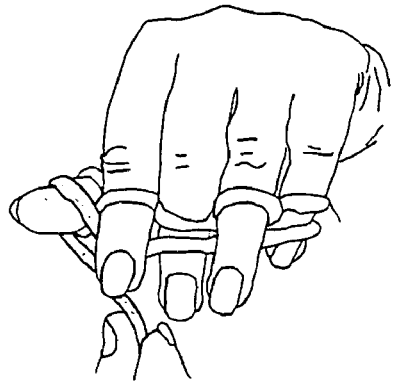
Figure 15:
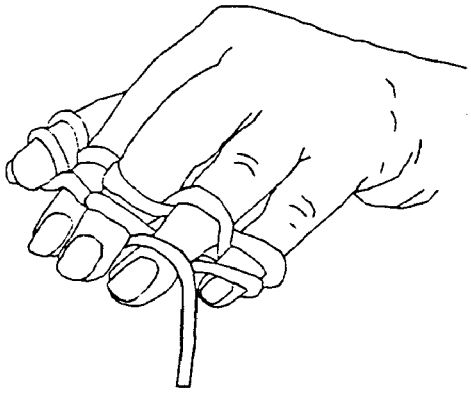
Figure 16:
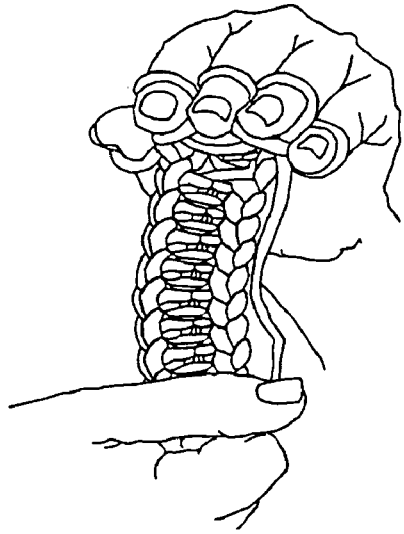

As seen FIG. 13 the weave can be continued with a new run which can begin under, then over the pinky and under the ring. The pattern can continue until the strand is resting on the thumb. In Figure the second run is shown beginning under the thumb to follow through over the index. In FIG. 15, the run is shown continuing the weaving pattern over to the ring where it can rest for the completion of a new row, similar to the row described in FIGS. 9–11. As seen in FIG. 16, snugly pulling on the tail reveals the definition of the rows of the weaving as the work progresses.

c. Tightening or Loosening the Weave

Figure 17:
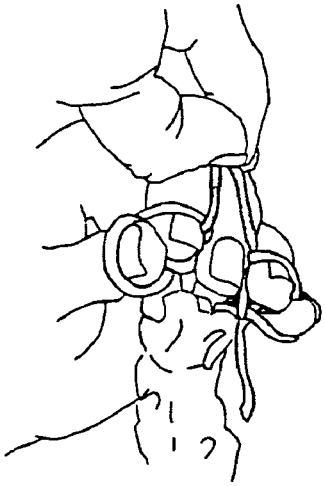
Figure 18:
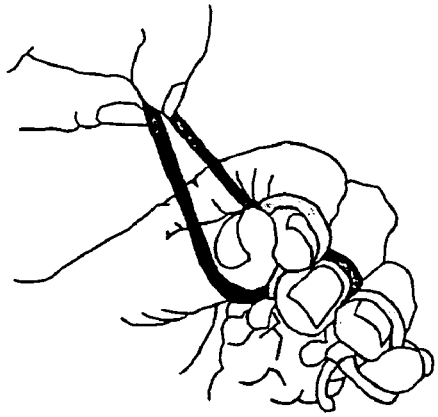
Figure 19:
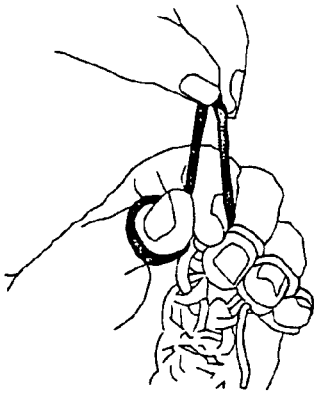
Figure 20:
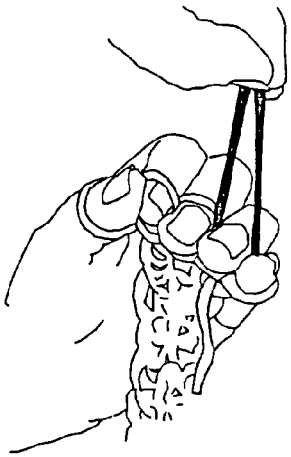

Throughout the weaving process, it may be necessary to either tighten or loosen the strand that is being used for the weaving. This may depend upon the nature of the fiber being used and the desired quality of the weave. The weaving can be tightened or loosened after the completion of a row. As seen in FIG. 17, to tighten the weaving, the single strand in place on the middle finger can be gently pulled upon until it feels snug upon the pinky. The single strand remaining on the thumb can then be gently pulled to tighten the strand around the middle finger (FIG. 18). The single strand remaining on the index can be gently pulled to tighten the strand around the thumb (FIG. 19). The single strand remaining on the ring can be gently pulled to tighten the strand around the index.

Figure 21:
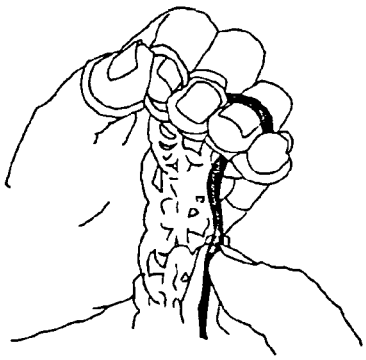
Figure 22:
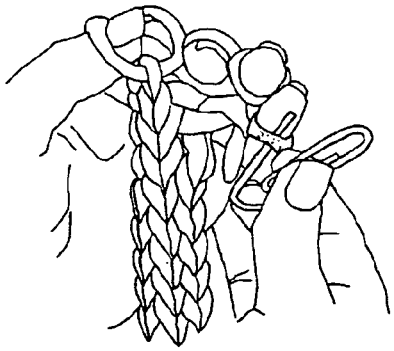

As seen in FIG. 21, the single strand handing from the ring can be gently pulled to tighten the strand on that digit. If the weaving needs to be loosened, the steps described above for FIGS. 17–21 can be performed in reverse order. Whether tightening or loosening the weaving, the amount of the strand increased in these steps can be controlled to help prevent the weave from becoming too loose or too tight. The quality of the weave can also be controlled with the placement of the strands upon the digits. The weaving can be tighter as it is placed closer to the fingernails. A larger weave can result as the weaving is placed closer to the base of the digits.

d. Securing and Storing the Weave

The weaving can be removed from the hand loom as needed and secured from unraveling with a variety of items. FIGS. 22–26 show the use of a securing device, such as a clip (i.e. paper clip, etc,) or pin (i.e. hair pin, etc.) as it is slipped into the loop on the pinky. Other common securing devices which will prevent unraveling, such as, but not limited to, other pins (i.e. bobby pins, safety pins, etc.) can also be used and are also considered within the scope of the invention. The pinky can be withdrawn from the weaving as the relative loop is in place upon the securing device. The securing device can be slipped into the loops of the successive digits which are then withdrawn from the weaving. Finally, the securing device can be slipped into the loop of the thumb. The thumb can then be withdrawn from its loop as the thumb loop is placed upon the securing device which is then bent back into shape to retain the head of the weaving. The weaving can be stored in a manner that prevents tangles to the product. The weaving may be replaced upon the hand loom by following the steps described for FIGS. 22–26 in reverse order. It is preferred to return the digit to the corresponding loop (begin with the thumb and ending with the pinky) prior to removing the securing device from that loop.

e. Terminating the Weave

Figure 27:
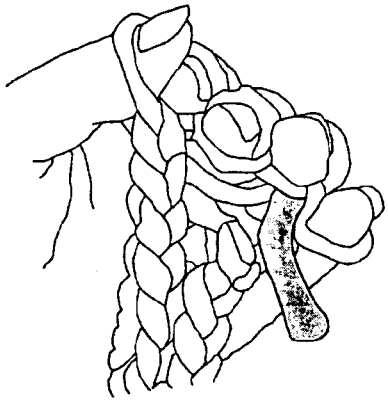
Figure 28:
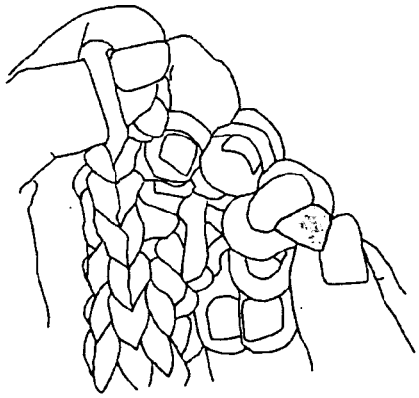

The weaving may be terminated by cutting the strand that is hanging from the ring finger (FIG. 27). As seen in FIG. 28 the cut end of the strand is shown taken through the loop on the pinky. The pinky can then be removed from the loop.

Figure 29:
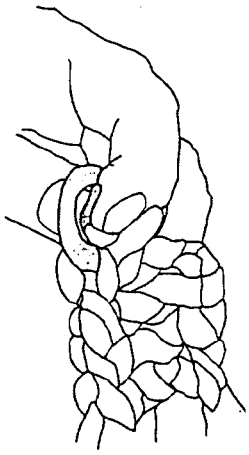

This process can be continued through the loops of each of the fingers. The end of the strand can then be passed through the loop of the thumb as the thumb is removed from the loop (FIG. 29). A gentle pull can be used to tighten the loops in the head of the weaving to help keep it secure.

f. Modifying the Length of the Weave

Figure 31:
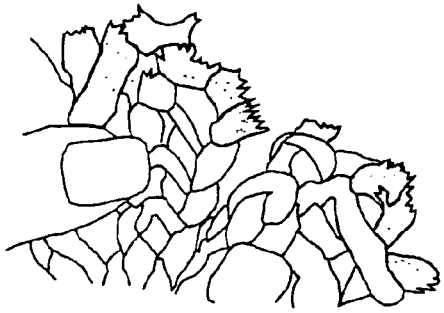
Figure 32:
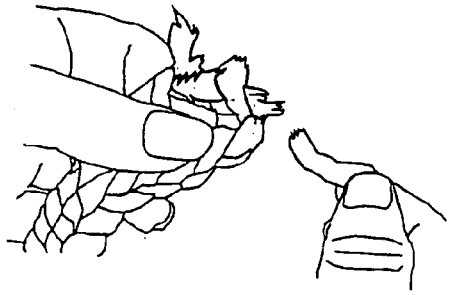
Figure 33:
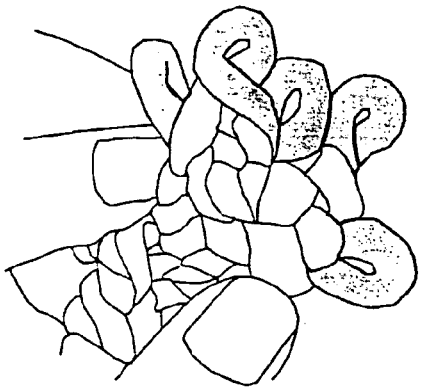
Figure 34:
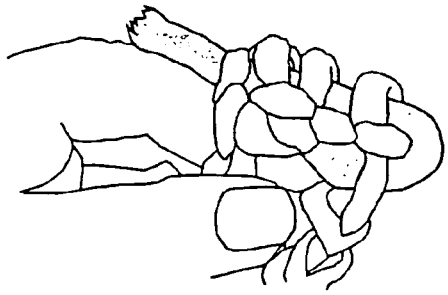
Figure 35:
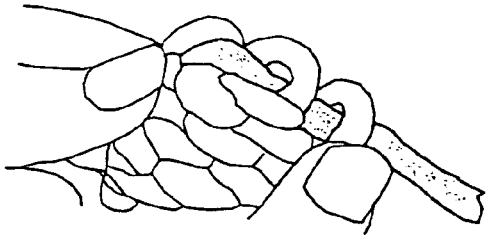

As seen in FIG. 30 any rib may be modified in length by cutting it preferably completely across in width. One fourth to one half of an inch in additional length can be retained to allow for the adjustment of the tail and the head, when preparing these parts for a product. Both cut ends may have many short, cut pieces (FIG. 31). As seen in FIG. 32, the cut pieces can be removed before the ends are prepared for a product. The new ends can become either a head or a tail, depending upon the proximity to the head and tail of the original rib (FIG. 33). The end that becomes a head can have five loops that can be secured similar to the securement previously shown in FIGS. 28 and 29. The head of the rib can be defined with five loops that can be secured by passing a strand through them (FIGS. 34 and 35).

g. Adding to the Width of the Weave

Figure 36:
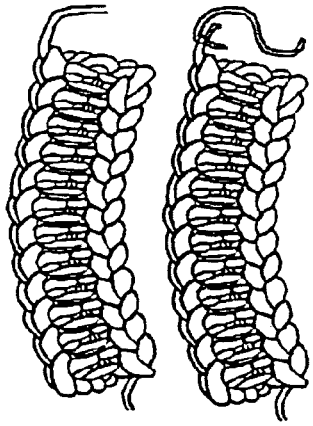
Figure 37:
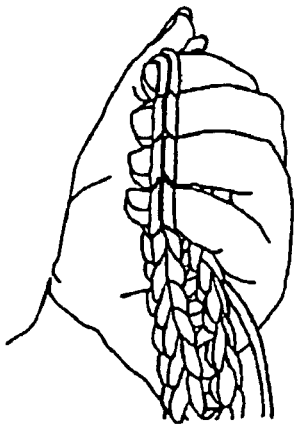
Figure 38:
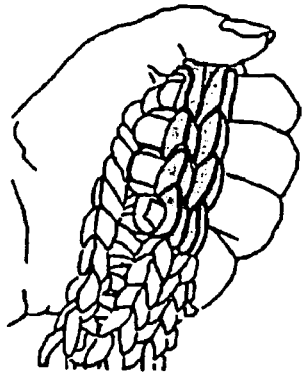

As seen in FIG. 36, two ribs may be joined together in a manner that will increase the width of the weaving. A tertiary strand can be tied or otherwise attached to the strand coming from the tail end of the rib from the loops on the side proximal to the second rib that will be attached to the first. It can be helpful to align the ribs so that the tails and heads are going the same direction. The first four loops on the side of the first rib that is to be attached to the second rib can be fitted onto the tips of the fingers, one loop for each finger (FIG. 37). The thumb can remain free to assist in this process. Next, the first four loops on the side of the second rib that is to be attached to the first rib can be fitted onto the same finger tips (FIG. 38). The strand discussed in FIG. 36 can then be guided into both sets of loops on the index finger (Finger 39). In beginning with the loops of the second rib that was placed on the finger to the other side of the loops of the first rib that was placed on the finger a consistent path can be maintained.

Figure 39:
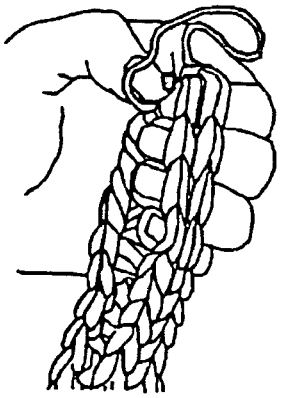
Figure 40:
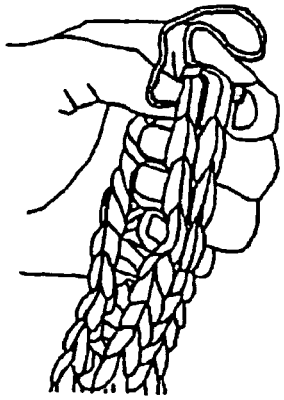
Figure 41:
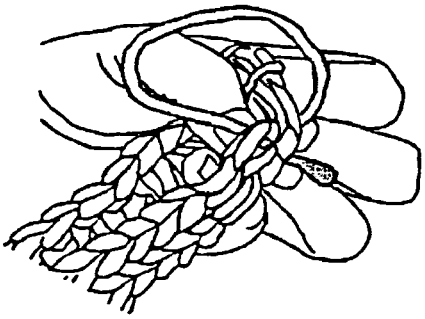
Figure 42:
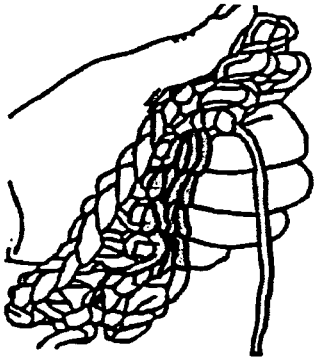

As the strand is passed completely through both sets of loops, the index finger can be removed from those loops (FIG. 40). As seen in FIG. 41, the joining strand can be passed through both sets of loops on each successive finger, with each successive finger being removed as the strand passed through, ending with the loops on the pinky. The next set of four loops can then be placed upon the corresponding fingers, always reserving the thumb to assist in the lacing process (FIG. 42). The joining strand is passed through both sets on each finger as shown in FIGS. 39–41. This process can be repeated until the desired width is achieved.

Figure 43:
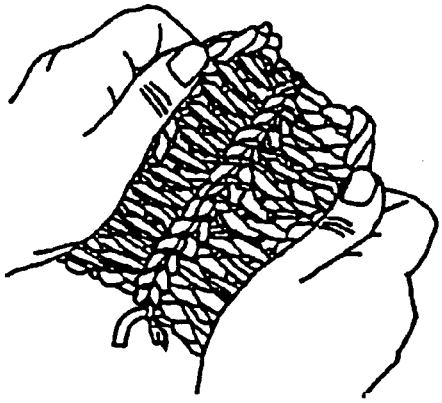

As seen in FIG. 43, the joining strand can be secured by tying it to the strand existing from the head of the first piece that was used in this process. A gentle pull can define the weave pattern. The other side of the weave appears as a series of loops in distinct longitudinal rows (FIG. 44).

h. Adding to the Length of the Weave or Creating a Band

Figure 45:
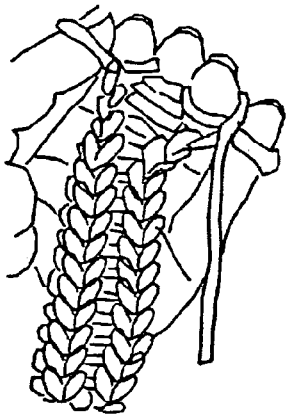

The head and tail may be joined to either increase the length of a given rib or to create a band. Before this step is begun, the length of the strand extending from the head and the tail can be examined. Preferably, the length of the strand can be at least two or three inches longer than the width of the rib. If necessary, additional length can be tied or otherwise attached to this strand by conventional means, such as, but not limited to, using a square knot. Beginning with the head, the loops can be placed upon each digit relative to the order of the row (FIG. 45). Preferably, the same loops can fit upon the digit it was generated upon.

Figure 46:
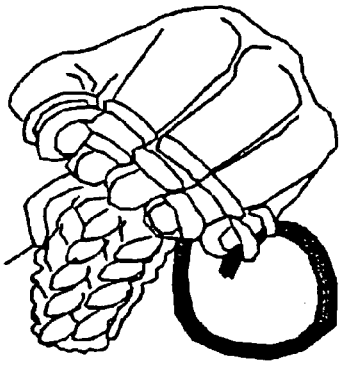
Figure 47:
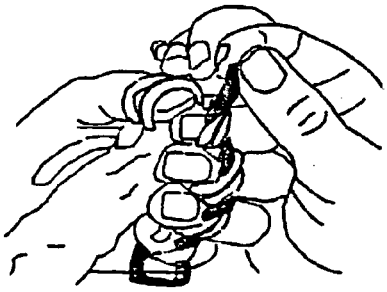
Figure 48:
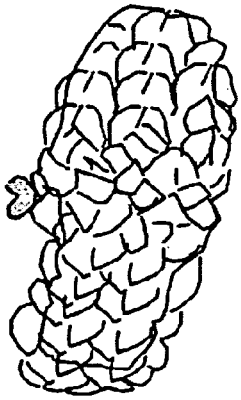

FIG. 46 shows that it may be a little more difficult to fit the tail loops upon the digits. Thus, it is preferred to find the best fit for each of the loops. As seen in FIG. 47 the terminated strand can be threaded through each set of loops as they rest on each digit in a methodical, sequential manner. Next, the strand can be gently pulled as it passes through the loops on each digit to take up any slack. The digits can be removed from the loops and the lacing strand can be secured such as, but not limited to, by tying a square knot with it and the strand existing from the tail. As seen in FIG. 48 this process can create a band if connecting the head and tail of a given rib or can create a longer rib if connecting the heads and tails of more than one rib.

While the invention has been described and disclosed in certain terms and has been illustrated by disclosure of certain embodiments or modifications, persons skilled in the art who have acquainted themselves with the invention will appreciate that it is not necessarily limited by such terms nor to the specific embodiments and modifications disclosed herein. Thus, a wide variety of alternatives, suggested by the teachings herein, can be practiced without departing from the spirit of the invention and are also considered within the scope of the invention.

The invention claimed is:

1. A method for hands only weaving comprising the steps of:

(a) providing a strand of weaving material;

(b) attaching a first end of the weaving material to a pinky finger of a user's first hand;

(c) creating, without a manufactured shuttle, a first run of weaving material by directing the weaving material from the pinky finger under a ring finger of the user's first hand, over a middle finger of the user's first hand, under an index finger of the user's first hand and over a thumb of the user's first hand all without a manufactured shuttle;

(d) creating a second run of weaving material by directing the weaving material under the thumb, over the index finger, under the middle finger, over the ring finger and under the pinky finger all without a manufactured shuttle;

(e) creating a third run of weaving material by directing the weaving material over the pinky finger, under the ring finger, over the middle finger, under the index finger and over the thumb all without a manufactured shuttle;

(f) creating a fourth run of weaving material by directing the weaving material under the thumb, over the index finger, under the middle finger, over the ring finger all without a manufactured shuttle to yield two runs of strands across a palm side and two runs of strands across a back side of the fingers of the user's first hand;

(g) lifting the first run and the second run over the third run and fourth run and off of each finger and thumb of the user's first hand to generate a weave on a palm side of the user's first hand; and (h) directing the weaving material under the pinky finger and then over the pinky finger continuing with a manufactured shuttle free weave by repeating steps (c) and (f) as necessary.

2. The method of claim 1 wherein steps (c) and (h) are performed with a user's second hand and without a manufactured shuttle.

3. The method of claim 2 wherein the user's first hand serves as a weaving loom and the user's second hand serves as a weaving shuttle.

4. The method of claim 1 further comprising the step of securing the created strands to prevent unraveling during an interruption in the weaving process.

5. The method of claim 4 wherein the step of securing inserting a securing member through loops created by the strands.

6. The method of claim 5 wherein the securing member is a clip or pin.

7. The method of claim 1 further comprising the step of modifying a length or width for the weave.

8. The method of claim 7 wherein the step of modifying includes attaching a second weave to either the end or side of the weave.

9. The method of claim 8 wherein the second weave is attached to either the end or side of the weave by lacing.

10. The method of claim 1 further comprising the step of terminating the weave.

11. The method of claim 10 wherein the step of terminating the weave includes cutting a strand hanging over a ring finger on the user's first hand and passing the hanging strand portion through loops of the weaving material disposed around the fingers of the user's first hand.

12. A method for hands only weaving comprising the steps of:

(a) providing a weaving material;

(b) attaching a first end of the weaving material to a pinky finger of a user's first hand;

(c) positioning with a user's second hand and without a manufactured shuttle, a first portion of the weaving material over, under and between the digits of the user's first hand until there is at least two runs of strands of the weaving material across a palm side and at least two runs of strands of the weaving material across a back side of the digits of the user's first hand, each strand in each run being associated with a specific digit of the user's first hand which is a different digit than the specific digits associated with the other strands in the same run;

(d) lifting a first at least one stand over the remaining positioned strands and removing the first at least one strand from an end of the digits of the user's first hand;

(e) positioning with the user's second hand and without a manufactured shuttle a second portion of the weaving material over, under and between the digits of the user's first hand until there is at least two strands of the weaving material across each of the digits of the user's first hand;

(f) lifting a second at least one strand over the remaining positioned strands and removing the second at least one strand from the end of the digits of the user's first hand;

(g) repeating steps (e) and (f) until an acceptable length has by woven for a created first rib of weavings; and (h) terminating the created first rib of weavings;

wherein the user's first hand serves as a weaving loom and the user's second hand serves as a weaving shuttle.

13. The method of claim 12 wherein the step of terminating the weave includes cutting a strand hanging over a ring finger on the user's first hand and passing the hanging strand portion through loops of the weaving material disposed around the fingers of the user's first hand.

14. The method of claim 12 further comprising the step of inserting a securing member through loops created by the strands to prevent unraveling of the strands during an interruption in the weaving process.

15. The method of claim 14 wherein the securing member is a clip or pin.

16. The method of claim 12 further comprising the step of modifying a length or width for the first rib of weavings by lacing a second rib of weavings to either the end or side of the first rib of weavings.

17. A method for hands only weaving comprising the steps of:

(a) providing a weaving material;

(b) attaching a first end of the weaving material to a pinky finger of a user's first hand;

(c) positioning, without a manufactured loom, a first portion of the weaving material over, under and between the digits of the user's first hand until there is at least two runs of strands of the weaving material across a palm side and at least two runs of stands across a back side of the digits of the user's first hand, each strand in each run being associated with a specific digit of the user's first hand which is a different digit than the specific digits associated with the other strands in the same run;

(d) lifting a first at least one stand over the remaining positioned strands and removing the first at least one strand from an end of the digits of the user's first hand;

(e) positioning, without a manufactured loom, a second portion of the weaving material over, under and between the digits of the user's first hand until there is at least two strands of the weaving material across each of the digits of the user's first hand;

(f) lifting a second at least one strand over the remaining positioned strands and removing the second at least one strand from the end of the digits of the user's first hand;

(g) repeating steps (e) and (f) until an acceptable length has by woven for a created first rib of weavings; and (h) terminating a weave by cutting a strand hanging over a ring finger on the user's first hand and passing the hanging strand portion through loops of the weaving material disposed around the fingers of the user's first hand.

18. The method of claim 17 further comprising the step of inserting a securing member through loops created by the strands to prevent unraveling of the strands during an interruption in the weaving process.

19. The method of claim 18 wherein the securing member is a clip or pin.

20. The method of claim 17 further comprising the step of a length or width for the first rib of weavings by lacing a second rib of weavings to either the end or side of the first rib of weavings.

* * * * *